US006144747A

United States Patent [19]

Scofield et al.

[11] Patent Number: 6,144,747

[45] **Date of Patent: *Nov. 7, 2000**

[54] HEAD MOUNTED SURROUND SOUND SYSTEM

[75] Inventors: William Clayton Scofield, Birmingham; Stevan Otha Saunders, Chelsea, both of Ala.

[73] Assignee: Sonics Associates, Inc., Birmingham, Ala.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/200,396

[22] Filed: Nov. 24, 1998

Related U.S. Application Data

[63] Continuation of application No. 08/832,377, Apr. 2, 1997, Pat. No. 5,841,879.

[51] Int. Cl.[7] ..... H04R 5/02

[52] U.S. Cl. ..... 381/309; 381/310; 381/74

[58] Field of Search ..... 381/1, 17, 18, 381/19, 20, 21, 303, 304, 305, 309, 310, 311, 27, 26, 37, 74, FOR 125, FOR 165, FOR 149, FOR 187

[56] References Cited

U.S. PATENT DOCUMENTS

| | | | |
|---|---|---|---|
| 3,249,696 | 5/1966 | Van Sickle . | |
| 3,697,692 | 10/1972 | Hafler . | |
| 3,849,600 | 11/1974 | Ohshima . | |
| 3,892,624 | 7/1975 | Shimada . | |
| 3,906,160 | 9/1975 | Nakamura et al. . | |
| 3,962,543 | 6/1976 | Blauert et al. | 381/310 |
| 4,087,629 | 5/1978 | Atoji et al. . | |
| 4,097,689 | 6/1978 | Yamada et al. | 381/310 |
| 4,110,583 | 8/1978 | Lepper . | |
| 4,239,937 | 12/1980 | Kampmann . | |
| 4,308,423 | 12/1981 | Cohen . | |
| 4,952,024 | 8/1990 | Gale . | |
| 4,967,268 | 10/1990 | Lipton et al. . | |
| 4,993,074 | 2/1991 | Carroll . | |
| 5,034,983 | 7/1991 | Cooper et al. | 381/310 |
| 5,261,005 | 11/1993 | Masayuki | 381/18 |
| 5,265,166 | 11/1993 | Madnick et al. | 381/1 |

(List continued on next page.)

FOREIGN PATENT DOCUMENTS

| | | | |
|---|---|---|---|
| 0 284 286 A2 | 3/1988 | European Pat. Off. . | |
| 0 421 681 A2 | 9/1990 | European Pat. Off. . | |
| 0 549 836 A1 | 12/1991 | European Pat. Off. . | |
| 0 424 1130 | 6/1993 | European Pat. Off. . | |
| 0 116 900 | of 0000 | Japan . | |
| 55077295 | of 0000 | Japan . | |
| 53-23601 | 3/1978 | Japan | 381/FOR 126 |
| 55-90197 | 7/1980 | Japan | 381/FOR 126 |

*Primary Examiner*—Forester W. Isen
*Assistant Examiner*—Xu Mei
*Attorney, Agent, or Firm*—Gregory M. Howison; Stephen S. Mosher

[57] ABSTRACT

A head mounted surround sound virtual positioning system that includes a video recorder (200), which is operable to have disposed therein a tape (202), having a surround sound audio track associated therewith. The surround sound system is encoded on two channels, which are output to a Dolby® decoder (204), which is operable to extract the five surround sound system channels therefrom. The left front, left rear, right front and right rear channels are input to a virtual positioning system (264), which is operable to virtually position each of the speakers relative to the head of the listener (26). These signals are then combined with a combining circuit (268) to provide the virtual positioning of only two speaker lines (58) and (60), disposed adjacent the right and left ears of the listener (26). The speakers (58) and (60) are disposed on the head mounted system such that they are fixed relative to, the ear of the listener and slightly forward of the ears and adjacent the head. The center speaker signal output of the decoder (204) is output from a separate external speaker (310).

14 Claims, 8 Drawing Sheets

U.S. PATENT DOCUMENTS 5,272,757 12/1993 Scofield et al. ..... 381/309
5,436,975 7/1995 Lowe et al. ..... 381/17
5,438,623 8/1995 Begault ..... 381/17
5,459,790 10/1995 Scofield et al. ..... 381/27
5,546,465 8/1996 Kim ..... 381/17
5,590,204 12/1996 Lee ..... 381/309
5,661,812 8/1997 Scofield et al. ..... 381/309
5,742,689 4/1998 Tucker et al. ..... 381/17
5,841,879 11/1998 Scofield et al. ..... 381/309

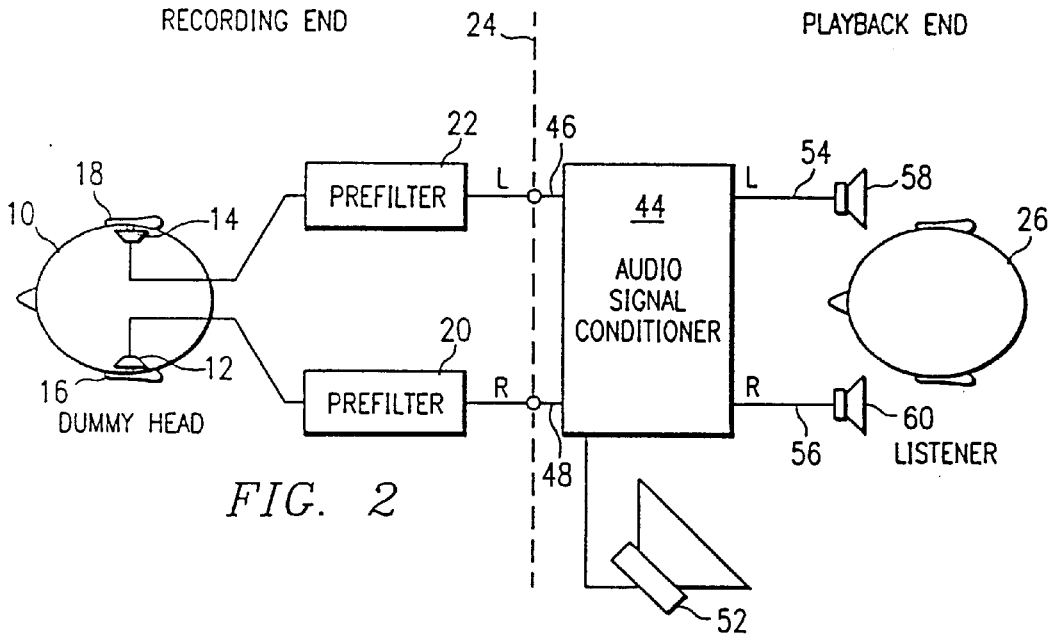
FIG. 2
FIG. 3
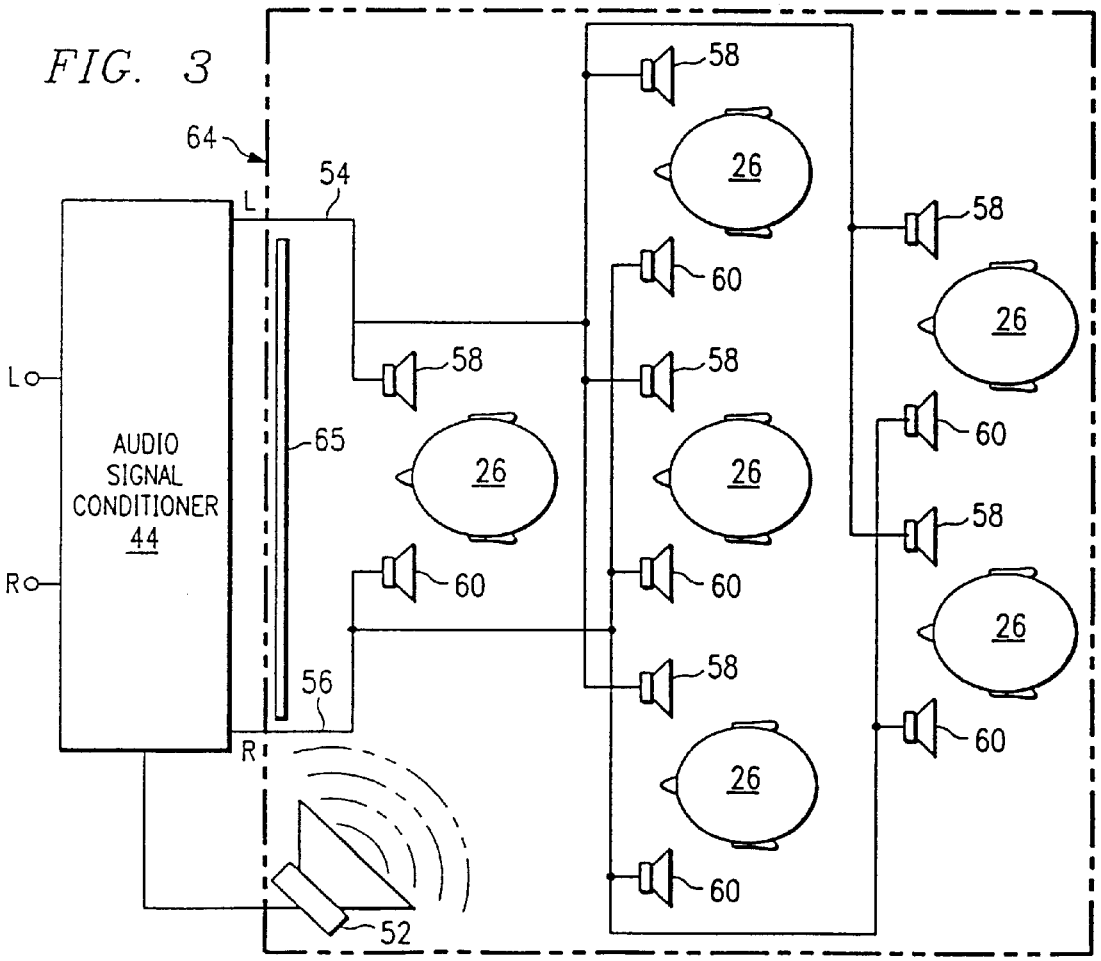

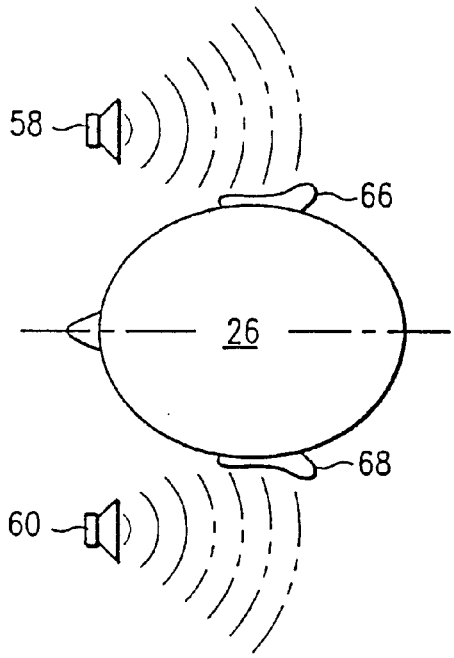
FIG. 4
FIG. 5
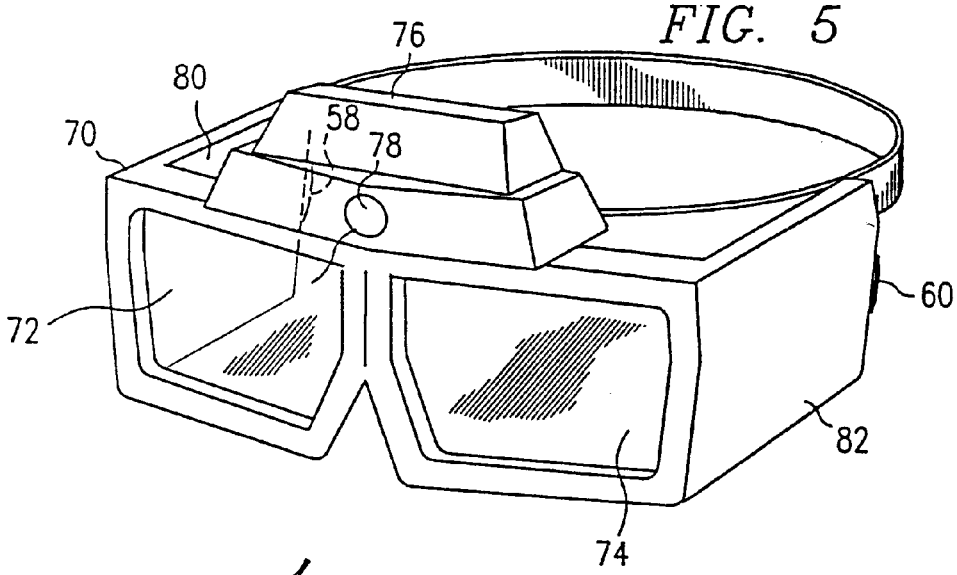
FIG. 6
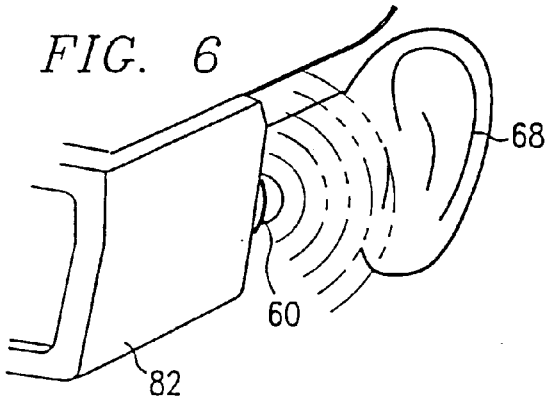
FIG. 7
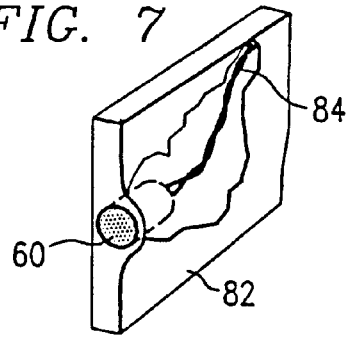

HEAD MOUNTED SURROUND SOUND SYSTEM

This application is a Continuation of application Ser. No. 08/832,377, filed Apr. 2, 1997, now U.S. Pat. No. 5,841,879.

CROSS REFERENCE TO RELATED APPLICATION

This is related to U.S. Pat. No. 5,272,757, issued Dec. 21, 1993, and entitled "Multi-Dimensional Sound Reproduction System", and to U.S. patent application Ser. No. 08/208,336, filed Mar. 8, 1994, now U.S. Pat. No. 5,459,790, and entitled "Personal Sound System with Virtually Positioned Lateral Speakers".

TECHNICAL FIELD OF THE INVENTION

The present invention pertains in general to a sound reproduction system, and more particularly, to a sound reproduction system for a head mounted surround sound system.

BACKGROUND OF THE INVENTION

In stereophonic sound systems, such as those found in home entertainment applications, there is an attempt to control the localization of sounds typically using balance potentiometers. In this process, the relative level between two loudspeakers affects where the phantom image will exist as perceived by a listener positioned equidistant from two loudspeakers with respect to a single plane. The perception of where the sound originates, i.e., the phantom image, has also been observed to be a function of the delay between the two otherwise identical sources. For gradual increasing delays, which are on the order of the Interaural Time Difference (I'D) between the ears, the phantom image will shift toward the real undecayed source, which is disposed away from the phantom image. As the amount of delay is increased toward 10 mS, sound direction is "fused" to the speaker from which the sound first arrived. In fact, it has been observed that if two similar sounds, which originate from separate sources, are delayed with respect to each other by an amount that is between 10 mS–50 mS, a listener who is positioned equidistant from the two loudspeakers will perceive the sound to be coming from the direction of the speaker whose sound arrives first, to the exclusion of the second speaker. This has been referred to as the Law of the First Wavefront, the Precedence Effect or the Haas Effect.

For sound arriving from two different sources, be they reflections or delayed sources, the sound can either appear as an echo to an individual, or as just a mere coloration of the direct sound. If the delay between two identical sounds is separated in time by around 10 mS, the sound will be perceived as a coloration of the direct sound, whereas for delays greater than around 50 mS, the sound will be perceived as an echo. Therefore, if the delayed sound were directed toward the listener from a rearward position with a delay between 10–50 mS relative to the direct sound, the listener would not perceive the location of the rearmost sound source, but, rather, he would experience a fuller and perhaps more intelligible sound at his location.

Essentially, the human ear tends to lock on sound which arrives first. The above observations can generally be explained based on the theory that the position of a sound source is cued by interaural differences in the intensity and time of arrival (phase). This is the so-called duplex theory of localization which states that phase is the main mechanism of the localization below 1500 Hz, while for frequencies above around 4000 Hz, intensity is the main localization cue. For the intervening range of frequencies, localization is not good and it may be that confusion comes about because of conflict between the two mechanisms over this range of frequencies. The duplex theory of localization will break down when it comes to defining unique sound source positions. A sound source which is located directly in front of a listener and one which is located directly behind a listener provides identical signals to the ears according to the duplex theory. However, it is a common everyday experience to discriminate between front and back localized sounds. There is much evidence to support the idea that a third mechanism contributes to the localization of sound, and that is the pinna transformation of sound.

Over the years, experiments have shown that the pinna performs a spectral modification which gives additional cues for the localization of sounds. This is particularly true with respect to elevation and front-back cues. The brain/nervous systems appears to process angular dependant spectral information in order to determine direction. This is due to the complex shape of the pinna which, when presented to a sound in front of the user, results in a significantly different response to the ear canal as compared to that for a sound originating from behind the listener. This spectral modification is also affected by the head and torso.

For multi-dimensional sound, typically referred to as 3-D sound, it is necessary to localize the sound, identify moving sound sources, enlarge the ideal listening area for the listener and remove the actual sound from a viewing area, such as a movie screen, to the individual. When considering only a single individual in a room, multi-dimensional sound has been reproduced through either headphones or through loudspeakers. With respect to the loudspeakers, it is important that the listener not move, since very complex systems have been developed which provide for cancellation of cross-talk between loudspeakers. Further, the rooms in which these experiments have been carried out typically are acoustically "dead" rooms.

One system that has been provided to reproduce binaural signals though loudspeakers is the Q-biphonic system. This system utilizes a binaural synthesizer that takes pre-recorded monaural sources and converts them into binaural signals along with loudspeaker cross-talk cancellation circuitry necessary for playback through loudspeakers. These systems claim to achieve full azimuthal localization in a four speaker system in addition to elevation localization. This system is very sensitive to head movement and is restricted to only one listening position. In the early days of this system, it was found that an anechoic space was needed.

Another solution proposed for a multi-dimensional system is one utilizing a multiple delay line system controlled by a personal computer. Provisions are made for six delay lines and an additional four non-delay lines. By utilizing a computer "mouse", which provides coordinate manipulation, sounds can be localized by controlling the signal arrival times between loudspeakers in a multiple speaker system. In addition to the adjustable delay, there is also an adjustable attenuation provided for each line. The individual delay times and attenuation calculations, which are accomplished on a computer, achieve the desired effect, i.e., phantom imaging. Delay times can be updated to account for moving sources through the use of the mouse, and preset configurations can be stored for future reference.

Some present research that is going on in the multi-dimensional sound system field is that for developing a multisensory "virtual environment" work station (VIEW) for use in space station teleoperation, tele-presence and automation activities. The auditory requirements for this project led to the prototyping of a binaural signal processor for converting generated or recorded sounds into binaural signals. Researchers measured a subject's pinna responses as a function of azimuth and elevation and arrived at pure head related transfer functions (HRTFs) using Fast Fourier Transform techniques. These HRTFs were implemented in a Digital Signal Processing (DSP) device which allowed the user to apply direction dependent equalization to an incoming signal. By establishing the proper relationship between the I'D, the Interaural Level Difference (ILD), and the HRTF, experimenters were able to synthesize free field stimuli and present this over headphones. Motion trajectories and static locations that represented greater resolution of HRTFs than measured were arrived at through interpolation. However, this system had some problems with front-back reversals.

To record binaural soundtracks, a recording system has been utilized that employs an artificial head for making the recordings. This is sometimes referred to as a "dummy" head. The system utilizes an artificial head that is fabricated from an anthropomorphic mannequin-like device that has lifelike pinnas and microphones disposed in the ear canals. The microphones are disposed on either side of the artificial head, and these microphones are utilized in conjunction with a binaural processor that converts the standard signals into binaural signals. The artificial head is typically utilized as an area microphone with additional circuitry provided for replicating the recordings of soloists which are converted and blended with the area recording.

In the recording process utilizing the artificial head, the head is equalized for a flat free-field response at frontal incidence. This accomplishes two things. First, the experience of listening to binaural recordings through headphones typically produces interior or "in-the-head" sounds. This is due to the disturbance of the conch resonance in the pinna by earphone cups, which causes a sense of nearness and "in the head" localization. The free-field equalization removes this resonance during recording, while for playback, the headphones are equalized to restore this resonance. It can be appreciated that the headphones destroy the natural conch resonance. The equalization of the response with the headphones results in better external localization, which is still imperfect because of the uniqueness of the transfer function of the pinna of each individual.

Secondly, the artificial head recordings made with the free-field equalization will reproduce with good results through regular stereo equipment. Furthermore, if these binaural recordings are reproduced through loudspeakers utilizing cross-talk cancelization (transaural listening), the conch resonance of the pinna is not presented twice, but is only restored by the natural action of the outer ear.

In U.S. Pat. No. 4,817,149, issued Mar. 28, 1989, a system is disclosed that enables sounds to be localized from all directions when played through headphones. Elevation and front/back cues are established utilizing direction-dependant filtering while horizontal (azimuthal) localization is achieved by control of interaural time differences.

In another application of multi-dimensional listening, theater goers have been provided what has sometimes been referred to as "surround sound", which is a technique by which speakers are disposed in front of and to the rear of the listener and to either side. Additionally, a center speaker is provided. The recorded sound is then mixed such that a position thereof is disposed at each speaker with the amplitude thereof varied such that the sound can be positioned relative to a listener in the middle of the room. This is referred to as a Dolby® sound system. However, the disadvantage to this type of system is that, when a listener moves from the center of the room, the effect is changed. This is due to the fact that the original recording assumed that the listener was in the center of the room. A further disadvantage to the system is that multiple speakers are required.

SUMMARY OF THE INVENTION

The present invention disclosed and claimed herein comprises a personal surround sound system for an individual listener. The surround sound system includes a head mounted binaural speaker system having a right binaural speaker disposed proximate to the right ear of the listener and a left binaural speaker disposed proximate to the left ear of the listener. A receiver is operable to receive individual decoded speaker signals for a surround sound system comprising left front, left rear, right front and right rear speaker signals. A virtual positioning signal is operable to position each of the left front, left rear, right front and right rear speaker signals such that they can be transmitted proximate the right and left ears of the listener as binaural signals through the right and left binaural speakers. As such, the virtually positioned signals are aurally perceived by the listener as being at the intended position of the associated left front, left rear, right front and right rear speaker signals. A combiner then combines the virtually positioned signals such that all four virtually positioned signals are combined to drive the right and left binaural speakers in accordance with the virtual positioning thereof.

In another aspect of the present invention, a center speaker signal is also provided which is operable to be directed toward a center speaker in front of the listener, this center speaker being external to the listener. Alternatively, the center speaker signal can be virtually positioned and combined to be output from the right and left binaural speakers.

In a further aspect of the present invention, a video device is provided for containing a surround sound system audio track. The audio track is input to a surround sound system decoder for decoding thereof to provide on the output thereof the left front, left rear, right front and right rear speaker signals. These are input to the receiver in a real time mode.

In a yet further aspect of the present invention, a head mounted bracket is provided for containing the right binaural speaker and the left binaural speaker. The right binaural speaker is disposed such that it is directed rearward toward the right ear and proximate to the zygomatic arch of the listener. Similarly, the left speaker is mounted on the bracket and directed rearward toward the left ear of the listener and proximate to the zygomatic arch of the listener.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a block diagram of the present invention;

FIG. 3 illustrates a diagram of the present invention utilized with a plurality of listeners in an auditorium;

FIG. 4 illustrates a detail of the orientation of the localized speakers;

FIG. 5 illustrates a perspective view of the support mechanism for these speakers;

FIG. 6 illustrates a side view of the housing and the localized speaker;

FIG. 7 illustrates a detail rear perspective view of the housing for containing one of the localized speakers;

DETAILED DESCRIPTION OF THE INVENTION

Figure 1A:
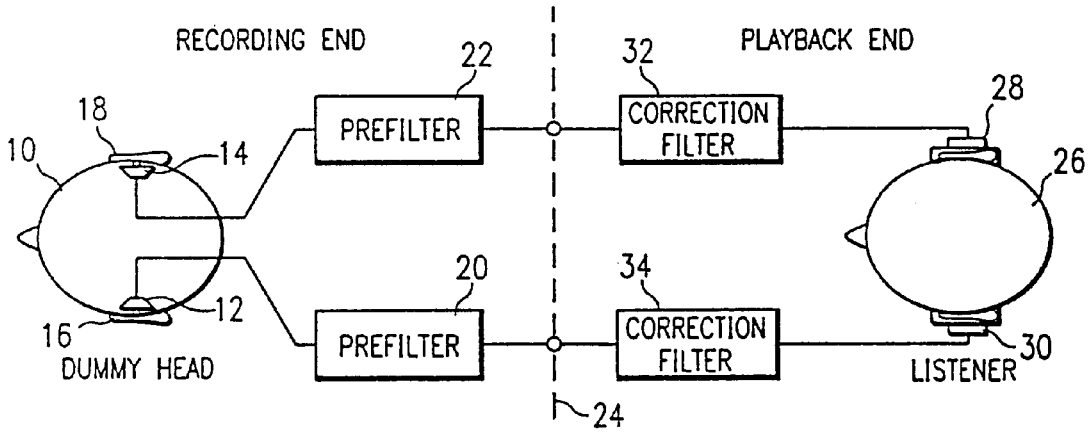
FIG. 1a (PRIOR ART)
FIGS. 1*a* and 1*b* illustrate diagrams of the prior art multi-dimensional sound systems.

Referring now to FIG. 1*a,* there is illustrated a schematic diagram of a prior art system for recording and playing back binaural sound. The prior art system is divided into a recording end and a playback end. In the recording end, a dummy head 10 is provided which has microphones 12 and 14 disposed in place of the ear canals. Two artificial pinnas 16 and 18, respectively, are provided for approximating the response of the human ear. The output of each of the microphones 12 and 14 is fed through pre-filters 20 and 22, respectively, to a plane 24, representing the barrier between the recording end and the playback end. The transfer function between the artificial ears 16 and 18 and the barrier 24 represents the first half of an equalizing system with the pre-filters 20 and 22 providing part of this equalization.

The playback end includes a listener 26 which has headphones comprised of a left earpiece 28 and a right earpiece 30. A correction filter 32 is provided between the barrier 24 and the earphone 28 and a correction filter 34 is provided between the barrier 24 and the earphone 30. The correction filter 34 is connected to the output of the pre-filter 20 and the correction filter 32 is connected to the output of the pre-filter 22. The transfer function between the barrier 24 and the earphone 30 represents the playback end transfer function. The product of the recording end transfer function and the playback end transfer function represents the overall transfer function of the system. The pre-filters 20 and 22 and the correction filters 32 and 34 provide an equalization which, when taken in conjunction with the response of the dummy head, should result in a true reproduction of the sound. It should be appreciated that the earphones 28 and 30 alter the natural response of the pinna for the listener 26, and therefore, the equalization process must account for this.

Figure 1B:
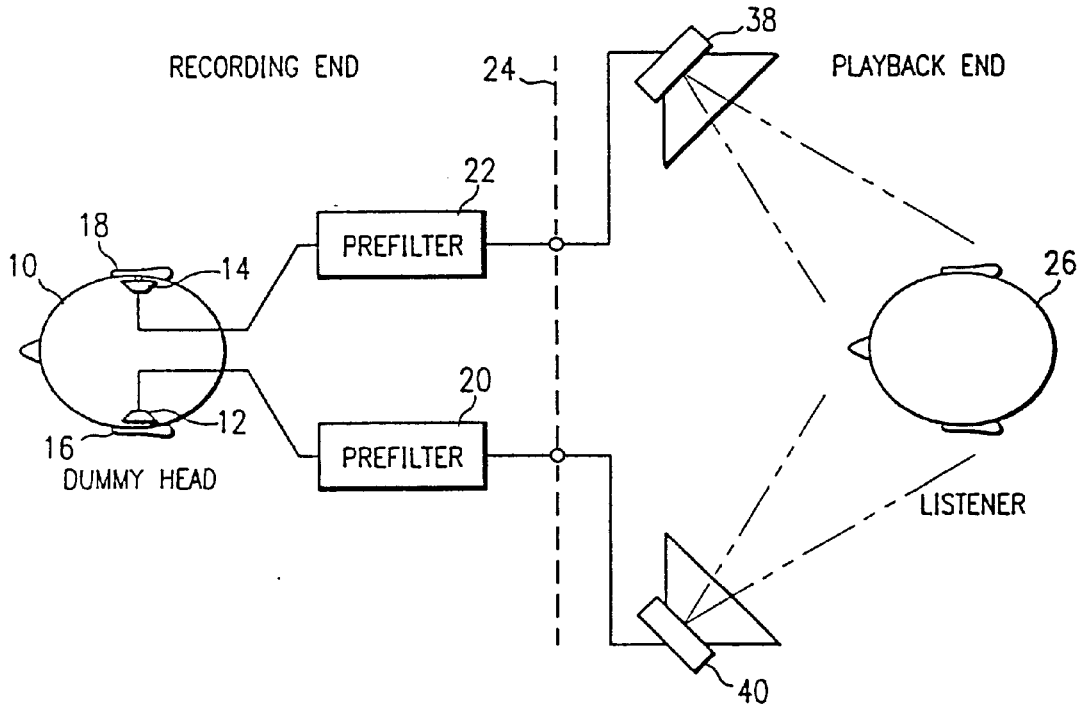
FIG. 1b (PRIOR ART)

Referring now to FIG. 1*b,* there is illustrated a diagrammatical representation of a prior art system, which is similar to the system of FIG. 1*a* with the exception that speakers 38 and 40 replace the headphones 28 and 30 and associated correction filters 32 and 34. However, when headphones are replaced by speakers, one problem that exists is cross-talk between the two speakers, since the speakers are typically disposed a large distance from the ears of the listener.

Therefore, sound emanating from speaker 40 can impinge upon both ears of the listener 26, as can sound emitted by speaker 38. Further, the room acoustics would also affect the sound reproduction in that reflections occur from the walls of the room.

Headphones, as compared to speakers, are usually equalized to a free field in that their transfer function ideally corresponds to that of a typical external ear when sound is presented in a free sound field directly from the front and from a considerable distance. This does not lend itself to reproduction from a loudspeaker. In general, loudspeakers will require some type of equalization to be performed at the recording end, but this will still result in distortions of tone and color. It can be seen that although the loudspeakers can be somewhat equalized with respect to a given position, the cross-talk of the speakers must be accounted for. However, when dealing with a large auditorium, this must occur for all the listeners at any given position, which is difficult at best.

Referring now to FIG. 2, there is illustrated a diagram of the head mounted system utilized in conjunction with the present invention. The binaural recording is input to a signal conditioner 44 as a left and a right signal on lines 46 and 48, respectively. The signal conditioner 44, as will be described hereinbelow, is operable to combine the left and the right signals for frequencies below 250 Hz and input them to low frequency speaker 52, there being no left or right distinctions made in the speaker 52. In addition, the left and right signals of lines 46 and 48 are output as separate signals on left and right lines 54 and 56 to localized speakers 58 and 60 which are disposed proximate to the ears of the listener 26. The localized speakers 58 and 60 are disposed such that they do not disturb the natural conch resonance of the ears of the listener 26, and they are disposed such that the sound emitted from either of the speakers 58 and 60 is significantly attenuated with respect to the hearing on the opposite side of the head. This is facilitated by disposing the localized speakers 58 and 60 proximate to the head such that the natural separation provided by the head will be maintained.

Only signals above 250 Hz are transmitted to the localized speakers 58 and 60. As will be described hereinbelow, a delay is provided to the sound emitted from localized speakers 58 and 60 as compared to that emitted from speaker 52, such that the sound emitted from speaker 52 will arrive at the location of the listener 26 at the approximate time that the sound is emitted from localized speakers 58 and 60, within at worst plus and minus 25 ms. This accounts for the sound delay through the room and the distance of the listener 26 from the speaker 52. It has been noted that the important localization cues are not contained in the low frequency portion of the signal. Therefore, this low frequency portion of the audio spectrum is split out and routed to the listeners through the speaker 52. In this manner, the amount of sound energy that can be output at the low frequencies is increased, since the small size of the transducers that will be utilized for the localized speakers 58 and 60 cannot reproduce low frequency sounds with any acceptable fidelity.

Referring now to FIG. 3, there is illustrated a diagram of the system utilized with a plurality of listeners 26. Each of the listeners 26 has associated therewith a set of localized speakers 58 and 60. The listeners 26 are disposed in a room 64 with the speaker 52 disposed in a predetermined and fixed location. Since it is desirable that sound from the speaker 52 arrive at all of the listeners 26 generally at the same time, the speaker 52 would be located some distance from the listeners 26, it being understood that FIG. 3 is not drawn to scale. A viewing screen 65 is disposed in front of the listeners 26 to provide visual cues.

The localized speakers 58 and 60 are supported on the heads of listeners 26 such that they are maintained at a predetermined and substantially fixed position relative to the head. Therefore, if the head were to move when, for example, viewing a movie, there would be no phase change in the sound arriving at either of the ears of the listener 26. Therefore, a support member is provided which is affixed to the head of the listener 26 to support the localized speakers 58 and 60. In the preferred embodiment, groups consisting of six listeners are connected to common wires 54 and 56, such that the localized speakers 58 and 60 associated with each of the listeners 26 in a common group are connected to these wires, respectively. The sound level is adjusted such that each listener 26 will hear the sound at the appropriate phase from the associated one of the localized speakers 58 and 60. However, it has been determined experimentally that a listener 26 disposed in an adjacent seat with sound being emitted from his associated localized speakers 58 and 60 will not interfere with the sound received by the one listener 26. This is due to the fact that the sound levels are relatively low. If the localized speakers 58 and 60 are removed, then a listener 26 can hear sound emitted from localized speakers 58 and 60 among the listeners' seats adjacent thereto. The human ear "locks" onto the sound emitted from its associated localized speakers 58 and 60 and tends to ignore the sound from speakers disposed adjacent thereto. This is the result of many factors, including the Law of the First Wavefront.

The combination of the localized speakers 58 and 60 and visual cues on the screen 65 provide an additional aspect to the listener's ability to localize sound. In general, the listener cannot localize sound very well when it is directly in front or in back of the listener's head. Some type of head movement or visual cue would normally facilitate localization of the sound. Since the localized speakers 58 and 60 are fixed to the listener's head, visual cues on the screen 65 provide the listeners 26 with additional information to assist in localizing the sound.

Referring now to FIG. 4, there is illustrated a detail of the orientation of the localized speakers 58 and 60 relative to the listener 26. The localized speaker 58 is disposed proximate to the right ear of the listener and its associated pinna 66. Similarly, the localized speaker 60 is disposed proximate to the left ear of the listener 26 and the associated pinna 68. In the preferred embodiment, the localized speakers 58 and 60 are disposed forward of the pinnas 66 and 68, respectively, and proximate to the head of the listener 26. It has been determined experimentally that the optimum sound reproduction occurs when the speaker is directed rearward and disposed proximate to the zygomatic arch of the listener 26. If the associated localized speaker 58 or 60 is moved outward, directly to the side of the ear, the actual physical size of the speaker tends to disturb the conch resonance. However, if the speaker were reduced to an extremely small size, this would be acceptable.

It is important that the speaker not be moved too far from the listener, as cross-talk would occur. Of course, any type of separation in the front, the rear or on top of the head would improve this. The torso, of course, provides separation beneath the head, but it would be necessary to improve the separation in the space forward, rearward and upward of the head if the localized speakers 58 and 60 were moved away from the head. However, in the preferred embodiment, the localized speakers 58 and 60 are designed to be utilized in an auditorium with multiple users all receiving the same or similar signals. Therefore, they are disposed as close to the ear as possible without disturbing the conch resonance and to minimize the sound level necessary for output from the localized speakers 58 and 60.

Referring now to FIG. 5, there is illustrated a perspective view of the support mechanism for the localized speakers 58 and 60. The localized speakers 58 and 60 are supported in a pair of three-dimensional glasses 70, which are designed for three-dimensional viewing. These glasses 70 typically have LCD lenses 72 and 74 which operate as shutters to provide the three-dimensional effect. A control circuit is disposed in a housing 76 which has a photo transistor 78 disposed on the frontal face thereof. The photo transistor 78 is part of a communications system that allows the synchronization signals to be transmitted to the glasses 70.

Housing 80 is disposed on one side of the glasses 70 for supporting the localized speaker 58. A housing 82 is disposed on the opposite side of the glasses 70 for supporting the localized speaker 60. The housings 80 and 82 provide the proper acoustic termination for the speakers 58 and 60, such that the frequency response thereof is optimized. The speakers 58 and 60 are typically fabricated from a dynamic loudspeaker, which is conventionally available for use in stereo headphones.

Referring now to FIG. 6, there is illustrated a side view of the housing 82 and the localized speaker 60. The localized speaker 60, as described above, is disposed such that it is proximate to the side of the head in the area of the zygomatic arch. It is directed rearward toward the pinna 68 of the left ear of the listener 26 with the sound emitted therefrom being picked up by the pinna 68 and the ear canal of the left ear of the listener 26.

Referring now to FIG. 7, there is illustrated a detailed view of the housing 82 and the speaker 60. The housing 82 is slightly widened at the mounting point for the localized speaker 60, which, as described above, is a small dynamic loudspeaker. A wire 84 is provided which is disposed through the housing 82 up to the control circuitry in the housing 76. Alternatively, the wire 84 can go to a separate control/driving circuit that is external to the housing 82 and the glasses 70. The housing 82 is fabricated such that it has a cavity disposed therein at the rear of the localized speaker 60. The size of this cavity is experimentally determined and is a function of the particular brand of dynamic loudspeaker utilized for the localized speakers 58 and 60. This cavity is determined by measuring the response of the particular dynamic loudspeaker with a variable cavity disposed on the rear side thereof. This cavity is varied until an acceptable response is achieved.

Figure 8:
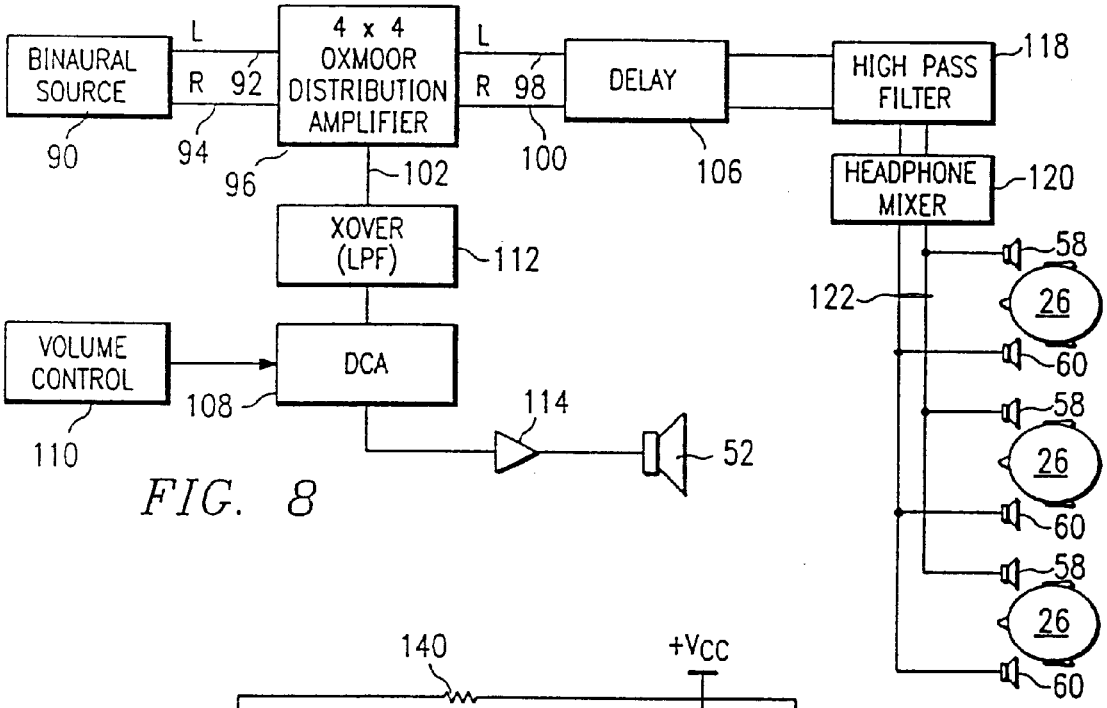
FIG. 8 illustrates a schematic block diagram of the system for generating the localized speaker driving signals.

Referring now to FIG. 8, there is illustrated a schematic block diagram of the system for driving the localized speakers 58 and 60 and also the low frequency speaker 52. The binaural recording system typically provides an output from a tape recording, which is played back and output from a binaural source 90 to provide left and right signals on lines 92 and 94. These are input to a 4×4 circuit 96 that outputs left and right signals on lines 98 and 100 for localized speakers 58 and 60, and also a summed signal on a line 102, which comprises the sum of both the left and right signals. The 4×4 circuit 96 is manufactured by OXMOOR CORPORATION as a Buffer Amplifier and is operable to receive up to four inputs and provide up to four outputs as any combination of the four inputs or as the buffered form of the inputs. The signal line 102 is output to a crossover circuit 112 which is essentially a low pass filter. This rejects all signals above approximately 250 Hz. The crossover circuit 112 is typical of Part No. AC 22, which is a stereo two-way crossover, manufactured by RANE CORPORATION. The output of the crossover 112 is input to a digital control amplifier (DCA) 108 to control the signal level. This is controlled by volume level control 110. The DCA 108 is typical of Part No. DCA-2, manufactured by OXMOOR CORPORATION. The output of the DCA 108 is input to an amplifier 114 which drives the speaker 52 with the low frequency signals. The amplifier 114 is typical of Part No. 800X, manufactured by SONICS ASSOCIATES, INCORPORATED.

The left and right signals on lines 98 and 100 from the 4×4 circuit 96 are input to a delay circuit 106, which is typical of Part No. DN775, which is a Stereo Mastering Digital Delay Line, manufactured by KLARK-TEKNIK ELECTRONICS INC. The outputs of the delay circuit 106 are input to a high pass filter 118 to reject all frequencies lower than 250 Hz. The high pass filter 118 is identical to the part utilized for the crossover circuit 112. The outputs of filter 118 are input to a headphone mixer 120 to provide separate signals on a multiplicity of lines 122, each set of lines comprising a left and a right line for an associated set of localized speakers 58 and 60 for listeners 26. This is typical of Part No. HC-6, which is a headphone console, manufactured by RANE CORPORATION. The lines 122 are routed to particular listeners' localized speakers 58 and 60.

Figure 9:
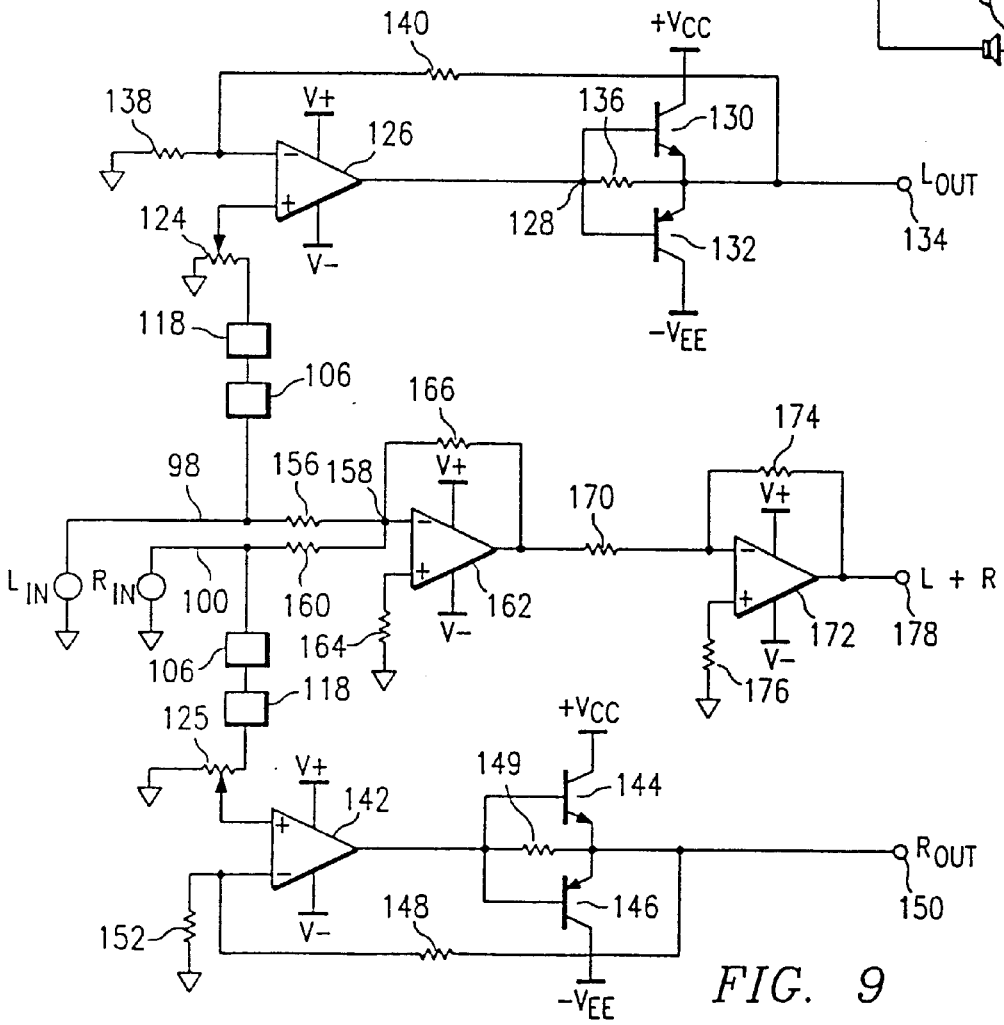
FIG. 9 illustrates a schematic diagram for generating the signals for driving the localized speakers.

Referring now to FIG. 9, there is illustrated a detailed schematic diagram of the circuit for driving the headphones. Line 98 is input through delay 106, and high pass filter 118 to the wiper of a volume control 124, the output of which is input to the positive input of an operational amplifier (op amp) 126. The output of op amp 126 is connected to a node 128 which is also connected to the base of both an NPN transistor 130 and a PNP transistor 132. Transistors 130 and 132 are configured in a push-pull configuration with the emitters thereof tied together and to an output terminal 134. The collector of transistor 130 is connected to a positive supply and the collector of transistor 132 is connected to a negative supply. The emitters of transistors 130 and 132 are also connected through a resistor 136 to the node 128. The negative input of the op amp 126 is connected through a resistor 138 to ground and also through a feedback resistor 140 to the output terminal 134.

An op amp 142 is provided with the positive input thereof connected to the output of volume control 125. The wiper of volume control 125 is connected through delay 106 and the filter 118. Op amp 142 is configured similar to op amp 126 with an associated NPN transistor 144 and PNP transistor 146, configured similar to transistors 130 and 132. A feedback resistor 148 is provided, similar to the resistor 140, with feedback resistor 148 connected to the negative input of op amp 142 and an output terminal 150. A resistor 152 is connected to the negative input of op amp 142 and ground. The volume controls 124 and 125 provide individual volume control by the listener 26.

Line 98 is also illustrated as connected through a summing resistor 156 to a summing node 158. Similarly, the line 100 is connected through a summing resistor 160 to the summing node 158. The summing node 158 is connected to the negative input of an op amp 162, the positive input of which is connected to ground through a resistor 164. The negative input of op amp 162 is connected to the output thereof through a feedback resistor 166. Op amp 162 is configured for unity gain at the first stage. The output of op amp 162 is connected through a resistor 170 to a negative input of an op amp 172. The negative input of op amp 172 is also connected to the output thereof through a resistor 174. The positive input of op amp 172 is connected to ground through a resistor 176. Op amp 172 is configured as a unity gain inverting amplifier. The output of op amp 172 is connected to an output terminal 178 to provide the sum of the left and right channels. The op amps 162 and 172 provide the function of the summing portion of 4×4 circuit 96, and are provided by way of illustration only.

Figure 10:
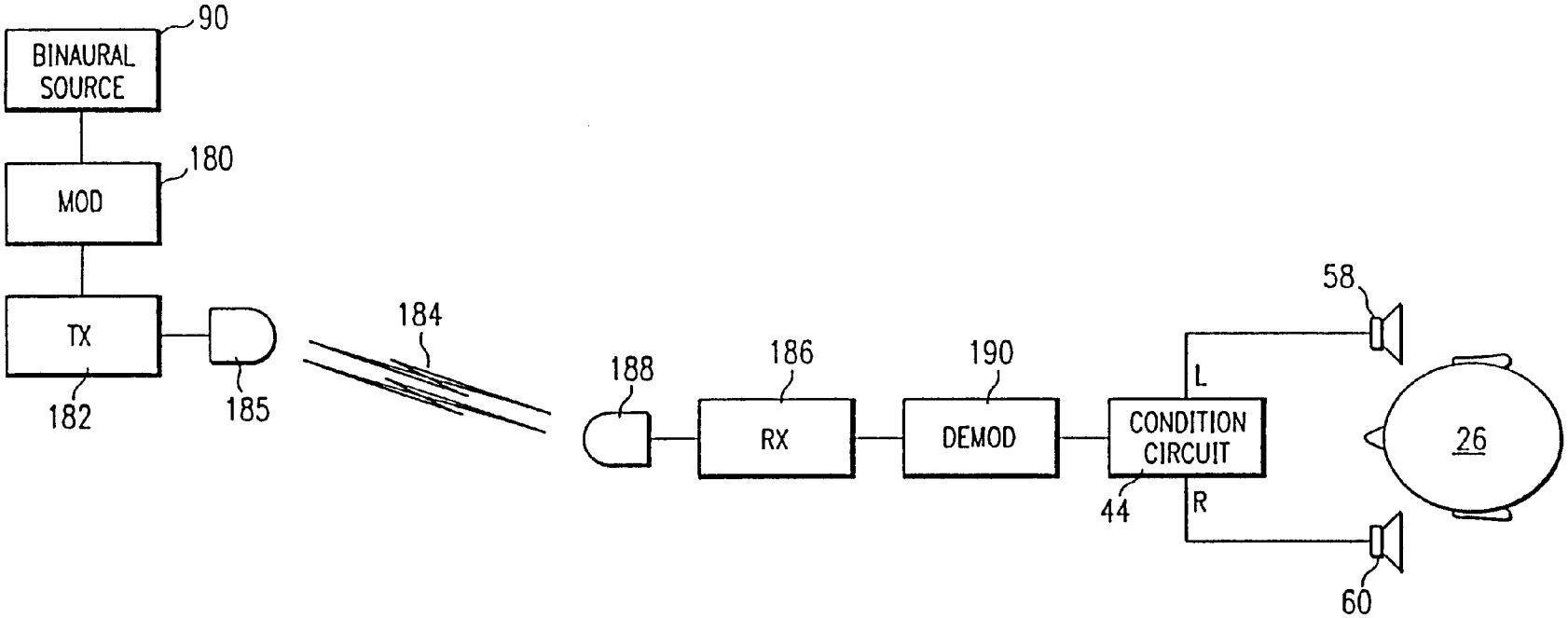
FIG. 10 illustrates a block diagram of an alternate method for transmitting the binaural signals to the listener over a wireless link.

Referring now to FIG. 10, there is illustrated a block diagram of an alternate method for transmitting the left and right signals to the localized speakers 58 and 60. The binaural source 90 has electronic signals modulated onto a carrier by a modulator 180, the carrier then transmitted by transmitter 182 over a data link 184. The data link 184 is comprised of an infrared data link that has an infrared transmitting diode 185 disposed on the transmitter 182. A receiver 186 is provided with a receiver Light Emitting Diode 188 that receives the transmitted carrier from the diode 185. The output of the receiver 186 is demodulated by a demodulator 190 and this provides a left and right signal for input to the conditioning circuit 44.

Figure 11:
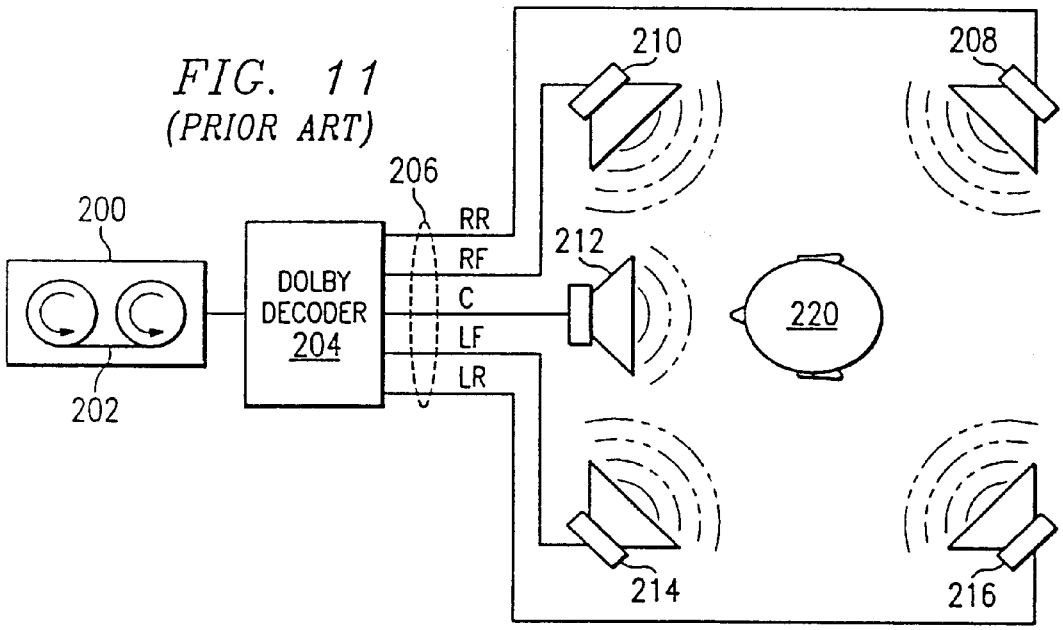
FIG. 11 (PRIOR ART)
FIG. 11 illustrates a diagrammatic view of a prior art surround sound system.

Referring now to FIG. 11, there is illustrated a prior art surround sound system. A conventional VCR 200 is provided which is operable to play a VCR tape 202. The VCR tape 202 is a conventional tape which has both video and sound disposed thereon. The soundtrack that is recorded is encoded with a Dolby® surround sound format such that there are typically five channels encoded thereon, a center front channel, a left front channel, a right front channel, a left rear channel and a right rear channel. Each of these is associated with a sound that is to be output from corresponding speakers. However, the VCR only outputs left and right channels and this is input to a Dolby® surround sound decoder 204 to provide the five decoded signals on line 206. The decoded signals are input to associated speakers, with the right rear signal directed to a right rear speaker 208, the right front signal directed to a right front speaker 210, the center front signal directed to a center front speaker 212, the left front signal directed to a left front speaker 214 and the left rear signal directed to a left rear speaker 216. The sound is positioned in a conventional manner such that a listener 220 disposed in the center of the speakers 208–216 will obtain the proper effect. However, if a listener moves to one side or the other, as is typical with a movie theater, a different effect will be achieved.

Figure 12:
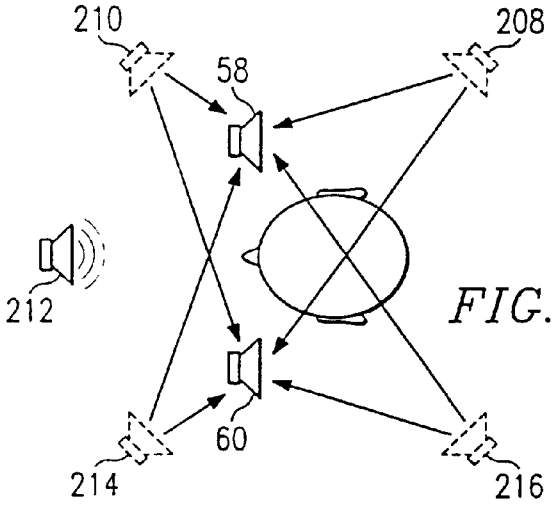
FIG. 12 illustrates a diagrammatic view of the head mounted surround sound system of the present invention for emulating the front and rear speakers.
Figure 13:
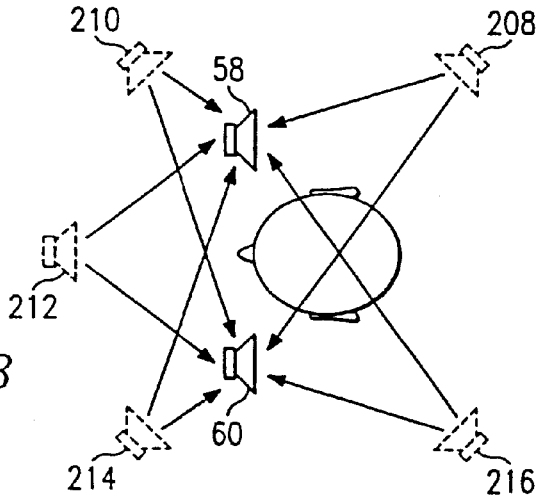
FIG. 13 illustrates a diagrammatic view of the head mounted system of the present invention for emulating the front and rear speakers and also the center speakers.

Referring now to FIG. 12, there is illustrated a diagrammatic view of the head mounted speaker system with the right speaker 58 and left speaker 60 directed rearward toward the ear of the listener with the inputs thereto binaurally mixed to emulate the right rear speaker 208, the right front speaker 210, left front speaker 214 and left rear speaker 216 with respect to the positioning information associated therewith. The center front speaker 212 is maintained in front of the listener such that the listener can obtain a fix relative thereto. However, the center front speaker 212 can also be binaurally linked, as illustrated in FIG. 13. The binaural mixing will be described hereinbelow.

It can be seen that once the binarural mixing is achieved, the listener now has associated with his position a virtual relative position to each of the left and right front speakers and left and right rear speakers. Further, this relationship is not a function of the listener's position within the theater, nor is it a function of the position of the listener's head. As such, the position of the listener within the theater is no longer important, as the virtual distance to each of the speakers remains the same. Further, the reflections of the walls of the theater are now minimized. Of course, the embodiment of FIG. 12 with the center front speaker 212 disposed external allows the listener to obtain a fix to the associated video. Typically, dialogue is exclusively routed to the center front speaker 212, although some sound mixers utilize the center front speaker to obtain different effects such as blending a small portion of the other channels onto the center front speaker 212.

Figure 14:
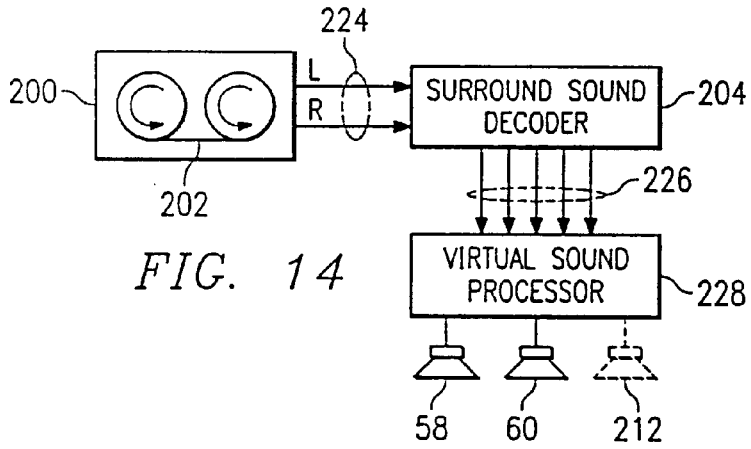
FIG. 14 illustrates a block diagram of the system for decoding the surround sound channels from a two channel VCR output and processing them to provide the inputs to the two head mounted speakers.

Referring now to FIG. 14, there is illustrated a simplified block diagram of the binaural mixing system of the present invention. The left and right outputs of the VCR 200 are provided on lines 224 to the surround sound decoder 204. The decoded outputs are comprised of five lines 226 that provide for the left front, left rear, right front and right rear speakers and the center front speaker. These are input to a virtual sound processor 228, which is operable to mix these signals for output on the speakers 58 and 60 and, preferably, to the center front speaker 212, which is illustrated in phantom to illustrate that this also could be mixed into the speakers 58 and 60. However, the preferred embodiment allows the center front speaker 212 to be separate.

The virtual sound processor 228 is a binaural mixing console (BMC), which is manufactured by Head Acoustics GmbH. The BMC is utilized to provide for binaural post processing of recorded mono and stereo signals to allow for binaural room simulation, the creation of movement effects, live recordings in auditoria, ancillary microphone sound engineering when recording with artificial head microphones and also studio production of music and drama. This system allows for virtual sound storage locations and reflections to be binaurally represented in real-time at the mixing console. Any sound source can be converted into a head-related signal. The BMC utilized in the present invention provides for three-dimensional positioning of the sound source utilizing two speakers, one disposed adjacent each ear of the listener. The controls on the BMC are associated with each input and allow an input sound source to be positioned anywhere relative to the listener on the same plane as the listener, or above and below the listener. This therefore gives the listener the impression that he or she is actually present in the room during the original musical performance. With the use of this system, the usual "in-head localization", which reduces listening pleasure in standard stereo reproduction, is removed. The operation of the BMC is described in the *BMC Binaural Mixing Console Manual,* published November 1993 by HeadAcoustics, which manual is incorporated herein by reference.

Figure 15:
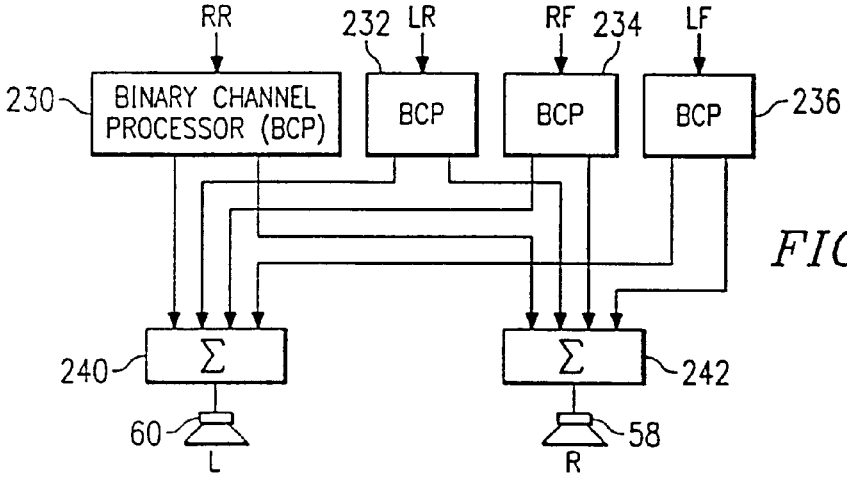
FIG. 15 illustrates a detail of the binary channel processor.

Referring now to FIG. 15, there is illustrated a block diagram of the BMC virtual sound processor 228. Each of the decoded signals for the right rear, left rear, right front and left front speakers are input through respective binaural channel processors (BCP) 230, 232, 234 and 236. Each of the BCPs 230–236 is operable to process the input signal such that it is positioned relative to the head of the listener via speakers 58 and 60 for that signal. The output of each of the BCPs 230–236 provide a left and right signal. The left signal is input to a summing circuit 240 and the right signal is input to a summing circuit 242. The summing circuits 240 and 242 provide an output to each of the speakers 60 and 58, respectively.

Figure 16:
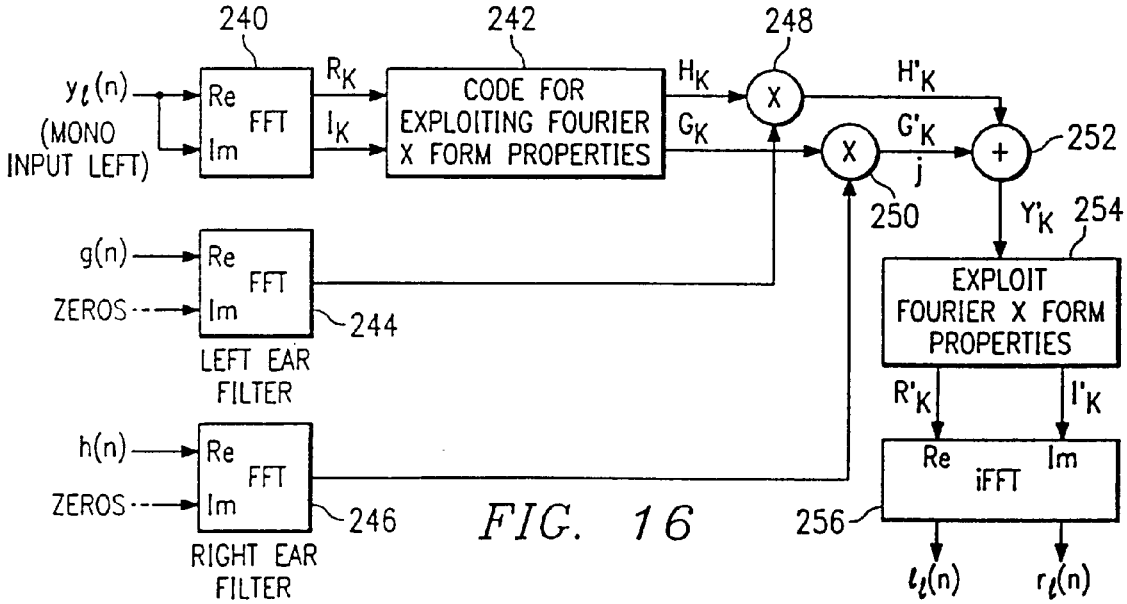
FIG. 16 illustrates a block diagram of a convolver for impressing the impulse response of a given theater or surrounding onto the decoded signals.

Referring now to FIG. 16, there is illustrated a block diagram of a system for providing real-time convolution in order to convolve the impulse response of a given environment, such as a theater. In addition to providing the surround sound system, it is also desirable to provide the surround sound system in conjunction with the acoustics of a given theater. Some theaters are specifically designed to facilitate the use of surround sound and they actually enhance the original surround sound of the audio track. This convolution may be performed directly in the computer in the time domain which, however, is a slow process unless some type of special computer architecture is utilized. Normally, convolution is usually in the form of its frequency domain equivalence since the Fourier transformation of the audio signal and impulse response, followed by the multiplication and inverse fast Fourier transformation of the result are faster than direct convolution. This method can be implemented with software or hardware. This type of convolution is often performed using a computer coupled to an array processor, the advantage being that input signals and room impulse responses may be arbitrarily long, limited only by the computer hard disk space. However, the disadvantage of the system is that the processing time of the impulse response is comparatively long. The present invention utilizes a digital signal processor (DSP) as a signal processor to provide a digital filter that can convolve a multiple channel impulse response and a predetermined sampling frequency in real time with only a few seconds of delay. One type of real-time convolver is that manufactured by Signal Logic Inc., which allows the user to perform either mono or binaural audible simulations ("auralizations") in real-time using off-the-shelf DSP/analog boards and multimedia boards. The filter inputs are typically any impulse response.

Referring further to FIG. 16, the transformation provided for convolving an input signal with an impulse response is illustrated with respect to the mono input to the left ear, the same diagram applying for the right ear. A fast Fourier transform device 240 is provided for receiving the real and imaginary parts of the mono input $y_l(n)$ and provides the fast Fourier transform of real and imaginary components $R_K$ and $I_K$. These are input to a processor 242 that is operable to contain the code for exploiting the Fourier transform properties to further process the Fourier transform. This provides on the output, the values $H_K$ and $G_K$. The impulse response $h_1(n)$ is input to the real input of a fast Fourier transform block 244, the imaginary input connected to a zero input. This provides a complex output that is multiplied by the value $H_K$ in the multiplication block 248, providing the output of the process value $H'_K$. The fast Fourier transform block 244 provides the filter function for the left ear. The right ear filtering operation is provided by a fast Fourier transform block 246, which receives the impulse response $h_2(n)$ on the real input and zeroes on the imaginary input. The output of the fast Fourier transform block 248 is input in multiplication blocks 250 for multiplication by the value $G_K$, providing on the output thereof the processed value $G'_K$. The value $H'_K$ and the value $G'_K$ are added in a summation block 252 to provide the value $Y'_K$, which is input to another processor 254 to exploit the Fourier transform properties thereof to provide on the output a real and imaginary components $R'_K$ and $I'_K$. These are input to the input of a fast Fourier transform block 256 to provide on the output the values $l_l(n)$ and $r_l(n)$, where $l_l(n)$ is the left portion of the signal for a source originating from the left and $r_l(n)$ is a signal that is input to the right ear that originated from the left. The algorithm implemented here is a conventional algorithm known as the "Overlap-Add" method.

It is noted that the fast Fourier transform blocks 244 and 246 provide the left and right ear filters, respectively, perform the transform once at run time and the results thereof are stored. Thus, only one fast Fourier transform operation is performed, followed by subsequent processing, which is followed by an inverse fast Fourier transform, all of which is performed in real-time. Improved performance is achieved by using the real and imaginary inputs to the FFT 240 and IFFT 256 blocks. The process illustrated by this is repeated for the right mono input channel to produce the values $l_r(n)$ and $r_r(n)$.

Figure 17:
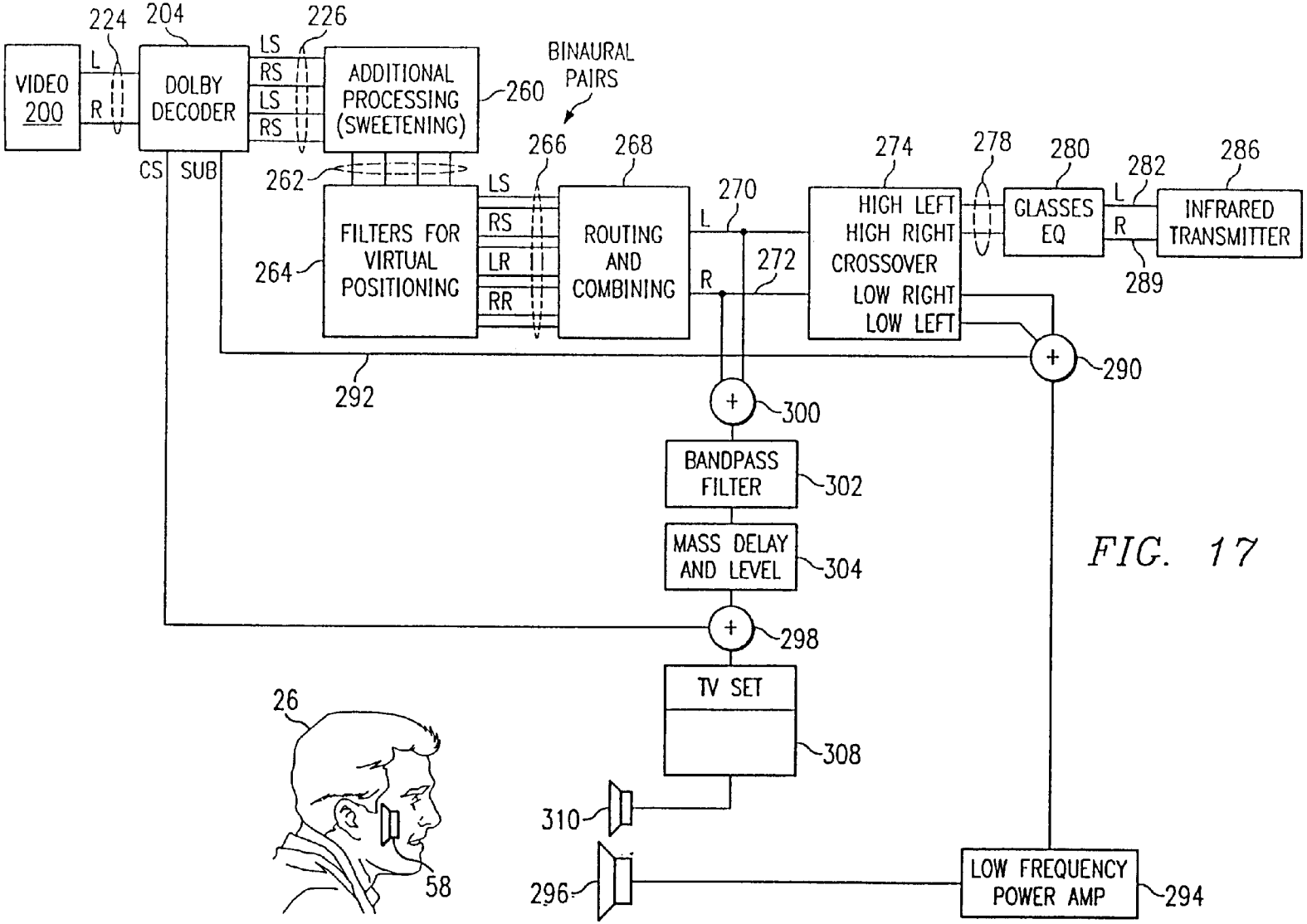
FIG. 17 illustrates an overall block diagram of the system of the present invention.

Referring now to FIG. 17, there is illustrated an overall block diagram of the system. The surround sound decoder 204 is operable to output the left front, right front, left rear and right rear signals on the lines 226 to a processing block 260 in order to provide some additional processing, i.e., "sweetening". This provides the modified decoded output signals on lines 262 for input to the binaural processing elements in a block 264 which basically provides the virtual positioning of each of the decoded output signals. This provides on the output thereof four signals on lines 266 that are still separate. These are input to a routing and combining block 268 that is operable to combine the signals on lines 266 for output on either a left speaker line 270 or a right speaker line 272. The functions provided by the blocks 264 and 268 are achieved through the binaural mixing console (BMC) 228 described hereinabove with respect to FIGS. 14 and 15.

The signals on lines 270 and 272 are input to a crossover circuit 274 which is operable to extract the left and right signals above a certain threshold frequency for output on two lines 278 for input to an equalizer circuit 280. Equalizer circuit 280 is operable to adjust the frequency response in accordance with a predetermined setting and then output to the drive signals on a left output line 282 and a right output line 289, these input to an infrared transmitter 286. Infrared transmitter 286 is operable to transmit the information to the glasses as described hereinabove.

The output of the crossover circuit 274 associated with the lower frequency components provides two lines 288 which are input to a summation circuit 290. This summation circuit 290 is operable to sum the two lines 288 with the subwoofer output of the decoder 204, this being a conventional output of the decoder, which output was derived from the original soundtrack in the videotape. This subwoofer output is on line 292. The output of summation circuit 290 is input to a low frequency amplifier 294 which is utilized to drive a low frequency speaker 296.

The center speaker output from the decoder 204 is input to a summation circuit 298, the summation circuit 290 also operable to receive a processed form of the signal that is input to the left and right ear of the left and right speakers 58 and 60 of the glasses. The signals on the lines 270 and 272 are input to a summation circuit 300, the summed output thereof input to a bandpass filter 302 and to a Haas delay circuit 304. This effectively blends the output of the headset with a delay for output on the speaker 310 such that the listener will not lock on the portion of the audio in the control speaker that was derived from the signals to the headset. The input to the summation circuit 300 could originate from the LF and RF outputs of the decoder 204 to enhance frontal localization. The output of the Haas delay circuit 304 is input to the summation circuit 298. The output of the summation circuit 298 is input to a conventional driving device such as a TV set 308, which drives a central speaker 310. The listener 26 can then be disposed in front of the speaker 310 and receive over the infrared communication link the surround sound encoded signals from the infrared transmitter 286.

In summary, there has been provided a head mounted surround sound system utilizing two speakers, one disposed adjacent and slightly forward of each ear of the listener, for emulating the four front and rear speakers of a surround sound system. The speakers are initially driven by a videotape that has a surround sound system encoded thereon in two channels. The two channels are extracted from the tape and input to a surround sound system decoder which is operable to decode at least five signals therefrom, one for a left front speaker, one for a left rear speaker, one for a right front speaker, one for a right rear speaker, in addition to one for a center speaker. The four front and rear speakers are then processed through a virtual positioning system and combine to provide two outputs, one for the left ear speaker and one for the right ear speaker of the system.

Although the preferred embodiment has been described in detail, it should be understood that various changes, substitutions and alterations can be made therein without departing from the spirit and scope of the invention as defined by the appended claims.

What is claimed is:

1. A personal surround sound system for an individual listener, comprising:

a receiver for receiving the individual decoded speaker signals corresponding to a single original performance or sound track for a surround sound system comprised of four speaker signals, left front, left rear, right front and right rear speaker signals representing sound sources disposed in an azimuthal plane in respective first positions;

a head mounted binaural speaker system having a right binaural speaker disposed proximate to the right ear of the listener and a left binaural speaker disposed proximate to the left ear of the speaker;

a virtual positioning system for positioning each of said left front, left rear, right front and right rear speaker signals relative to the listener such that said virtually positioned left front, left rear, right front and right rear speaker signals can be transmitted proximate to the right and left ear of the listener as binaural signals through said right and left binaural speakers, but are actually perceived by the listener as being within, or displaced above or below said azimuthal plane relative to said first positions of the associated left front, left rear, right front and right rear speaker signals; and a combiner for combining said virtually positioned left front, left rear, right front and right rear speaker signals such that all four virtually positioned left front, left rear, right front and right rear speaker signals are combined to drive said right and left binaural speakers.

2. The personal surround sound system of claim 1, wherein said receiver is operable to further receive a center speaker signal for the surround sound system and output the center speaker signal on an external speaker disposed in front of the listener.

3. The personal surround sound system of claim 2, and further comprising a summation circuit for summing together a portion of each of said left front, left rear, right front and right rear speaker signals as a composite signal with said center speaker signal for output on said center speaker.

4. The personal surround sound system of claim 3 and further comprising a delay circuit for introducing a predetermined amount of delay into the signal input to said center speaker.

5. The personal surround sound system of claim 1, and further comprising a video device for containing an encoded surround sound system audio track with surround sound speaker signals comprised of said left front, left rear, right front and right rear speaker signals encoded therein and a decoder for decoding said surround sound system speaker signals from said audio track for input to said receiver.

6. The personal surround sound system of claim 1, wherein said right binaural speaker and said left binaural speaker are mounted on a support bracket disposed on the head of the listener and directed rearward toward the ears and disposed away from the ears.

7. The personal surround sound system of claim 6, wherein said right binaural speaker and said left binaural speaker are disposed proximate to the zygomatic arch on the respective side of the head of the listener and directed rearward toward the respective ear of the listener.

8. The personal surround sound system of claim 1, wherein said receiver is further operable to receive a center speaker signal in addition to the four speaker signals and said virtual positioning system is operable to position said center speaker signal as a virtually positioned center speaker signal such that it can be transmitted proximate the right and left ear of the listener as binaural signals through said right and left binaural speakers, but is actually perceived by the listener as being at the intended position of said center speaker signal in the front of the listener, and said combiner is operable to combine said virtually positioned center speaker signal with said four virtually positioned, left front, left rear, right front and right rear speaker signals.

9. A method for reproducing a surround sound audio track proximate to the head of an individual listener, comprising the steps of:

receiving individual decoded speaker signals corresponding to a single original performance or sound track for a surround sound system comprised of four speaker signals, a left front, a left rear, a right front and a right rear speaker signal representing sound sources disposed in an azimuthal plane in respective first positions;

virtually positioning each of the left front, left rear, right front and right rear speaker signals such that they can be transmitted proximate to the right and left ear of the listener as binaural signals, but are actually perceived by the listener as being within, or displaced above or below the azimuthal plane relative to the first positions of the associated left front, left rear, right front and right rear speaker signals;

disposing a right speaker proximate to the right ear of the listener and a left speaker proximate to the left ear of a speaker; and combining the virtually positioned left front, left rear, right front and right rear speaker signals in the left speaker and right speaker such that all four virtually positioned left front, left rear, right front and right rear speaker signals are combined to drive the right and left speakers.

10. The method of claim 9, and further comprising:

providing a video device having a surround sound audio track disposed thereon having the left front, left rear, right front and right rear speaker signals encoded therein; and extracting the audio track from the video device and decoding the left front, left rear, right front and right rear speaker signals therefrom for the step of receiving.

11. The method of claim 9, and further comprising:

receiving a center speaker signal associated with the surround sound system;

providing an external center speaker; and driving an external center speaker with the center speaker signal in front of the listener.

12. The method of claim 11, and further comprising summing together a portion of each of the left front, left rear, right front and right rear speaker signals as a composite signal with the center speaker signal for output on the center speaker.

13. The method of claim 12 and further comprising introducing a predetermined amount of delay into the signal input to the center speaker.

14. The method of claim 9, wherein the step of disposing the right speaker proximate to the right ear of the listener and the left speaker proximate to the left ear of the listener comprises:

disposing a head mounted bracket on the head of the listener;

mounting the right speaker on the bracket proximate to the right ear of the listener and then directed rearward toward the right ear of the listener; and mounting the left speaker on the bracket and directed rearward toward the left ear of the listener.

* * * * *